US008534390B2

(12) United States Patent
Bouaphanh

(10) Patent No.: US 8,534,390 B2
(45) **Date of Patent: *Sep. 17, 2013**

(54) WEAR RESISTANT MATERIAL FOR THE SHIRTTAIL OUTER SURFACE OF A ROTARY CONE DRILL BIT

(75) Inventor: Inpeng Bouaphanh, Carrollton, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 273 days.

This patent is subject to a terminal disclaimer.

(21) Appl. No.: 12/896,484

(22) Filed: Oct. 1, 2010

(65) Prior Publication Data

US 2012/0080237 A1 Apr. 5, 2012

(51) Int. Cl.
*E21B 10/14* (2006.01)

(52) U.S. Cl.
USPC ..... 175/374; 175/432

(58) Field of Classification Search
USPC ..... 175/374, 336, 435, 432
See application file for complete search history.

(56) References Cited

U.S. PATENT DOCUMENTS

| | | | | |
|---|---|---|---|---|
| 3,389,761 | A | 6/1968 | Ott | |
| 3,461,983 | A * | 8/1969 | Hudson et al. | 175/375 |
| 4,421,184 | A | 12/1983 | Mullins | |
| 4,531,595 | A | 7/1985 | Housman | |
| 4,591,008 | A * | 5/1986 | Oliver | 175/227 |
| 5,074,367 | A * | 12/1991 | Estes | 175/374 |
| 5,145,016 | A | 9/1992 | Estes | |
| 5,289,889 | A | 3/1994 | Gearhart et al. | |
| 5,415,243 | A | 5/1995 | Lyon et al. | |
| 5,494,123 | A | 2/1996 | Nguyen | |
| 5,570,750 | A | 11/1996 | Williams | |
| 5,644,956 | A * | 7/1997 | Blackman et al. | 76/108.2 |
| 5,709,278 | A | 1/1998 | Crawford | |
| 5,975,223 | A * | 11/1999 | Karlsson | 175/374 |
| 6,116,357 | A | 9/2000 | Wagoner et al. | |
| 6,296,067 | B1 * | 10/2001 | Slaughter et al. | 175/228 |
| 6,336,512 | B1 | 1/2002 | Siracki et al. | |
| 6,446,739 | B1 | 9/2002 | Richman et al. | |
| 6,450,270 | B1 | 9/2002 | Saxton | |
| 6,575,350 | B2 | 6/2003 | Evans et al. | |
| 6,607,047 | B1 * | 8/2003 | Swadi et al. | 175/374 |
| 6,619,412 | B2 | 9/2003 | Slaughter, Jr. et al. | |
| 6,688,410 | B1 * | 2/2004 | Singh et al. | 175/374 |
| 6,955,233 | B2 | 10/2005 | Crowe et al. | |
| 7,350,600 | B2 | 4/2008 | Beuershausen et al. | |
| 7,621,347 | B2 | 11/2009 | Overstreet | |
| 8,096,373 | B2 | 1/2012 | Patel et al. | |
| 2002/0035895 | A1 | 3/2002 | Davies et al. | |

(Continued)

OTHER PUBLICATIONS

International Search Report and Written Opinion for PCT/US2011/052714 mailed Jan. 9, 2012 (8 pages).

*Primary Examiner* — Daniel P Stephenson
(74) *Attorney, Agent, or Firm* — Gardere Wynne Sewell LLP; Andre M. Szuwalski

(57) ABSTRACT

A rotary cone drill bit includes: a body, a leg depending from the body, a bearing shaft extending from the leg and a cone mounted to the bearing shaft. The leg includes a surface location that is subject to wear during operation of the bit. A bottom surface of a hard material plate is attached to a substantially conforming surface of the leg at the location subject to wear. The attachment of the conforming surfaces is made using a flowable material such as a brazing material.

38 Claims, 8 Drawing Sheets

(56) References Cited

U.S. PATENT DOCUMENTS

| | | | | |
|---|---|---|---|---|
| 2004/0173384 | A1* | 9/2004 | Yong et al. | 175/374 |
| 2006/0213692 | A1* | 9/2006 | Singh et al. | 175/339 |
| 2007/0163812 | A1 | 7/2007 | Overstreet et al. | |
| 2008/0202817 | A1 | 8/2008 | Massey et al. | |
| 2009/0032572 | A1* | 2/2009 | Oxfdord et al. | 228/198 |
| 2009/0038442 | A1 | 2/2009 | Shamburger et al. | |
| 2010/0071961 | A1 | 3/2010 | Steel et al. | |
| 2010/0101866 | A1 | 4/2010 | Bird | |
| 2010/0224418 | A1* | 9/2010 | Eason et al. | 175/340 |
| 2012/0080236 | A1 | 4/2012 | Bouaphanh | |
| 2012/0080237 | A1 | 4/2012 | Bouaphanh | |
| 2012/0080238 | A1 | 4/2012 | Bouaphanh | |

* cited by examiner

WEAR RESISTANT MATERIAL FOR THE SHIRTTAIL OUTER SURFACE OF A ROTARY CONE DRILL BIT

CROSS-REFERENCE TO RELATED APPLICATION

The present application is related to co-pending U.S. application for patent Ser. No. 12/896,406 filed Oct. 1, 2010 entitled "Wear Resistant Material at the Shirttail Edge and Leading Edge of a Rotary Cone Drill Bit", the disclosure of which is hereby incorporated by reference to the maximum extent allowable by law.

BACKGROUND

1. Technical Field of the Invention

The present invention relates to earth boring bits, and more particularly to those having rotatable cutters, also known as rotary cone drill bits.

2. Description of Related Art

Reference is made to FIGS. 1 and 2, wherein FIG. 1 illustrates an isometric view of a prior art rotary cone drill bit 10 and FIG. 2 illustrates a cross-sectional view of a portion of the prior art rotary cone drill bit 10 of FIG. 1. A leg 12 depends from a body portion 14 of the drill bit 10. The leg 12 includes a bearing shaft 16 which extends in a downward and radial inward direction. The bearing shaft 16 includes a cylindrical bearing surface 18. A cutter cone 20 is mounted to the bearing shaft 16 and supported for rotation by the bearing surface 18. In an alternative implementation, the cutter cone 20 is supported for rotation on the bearing shaft 16 by a set of roller bearings. The shape and configuration of the cone 20, as well its rotatable attachment to the bearing shaft 16, is well known in the art. In sealed bearing implementations, the bearing (journal or roller) between the cone 20 and bearing shaft 16 is lubricated by a lubricant (such as a grease) that fills regions adjacent to the bearing as well as other passages 21 in the rotary cone drill bit in a manner well known by those skilled in the art. This lubricant is retained within the rotary cone drill bit through the use of, for example, a resilient seal in the form of an o-ring 22 positioned in a seal gland 24 between the inner cylindrical surface 26 near the base of the cone 20 and the outer cylindrical surface 28 near the base of the bearing shaft 16.

The outer surface 30 of the leg 12 terminates at a semicircular edge 32 proximal to the cone 20. The region of the leg 12 associated with the surface 30 is known in the art as the "shirttail region," and the edge 32 is known in the art as the "shirttail edge." The shirttail edge 32 is provided where the terminal portion of the surface 30 transitions to an inside radial surface 34 oriented parallel to the base of the cone 20 (and perpendicular to the bearing shaft 16) and positioned at the base of the bearing shaft 16. On a rotary cone drill bit 10, one of the primary forms of bit failure can be traced back to shirttail wear. In one form of such shirttail wear, the shirttail edge 32 wears down, the radial extent of the inside radial surface 34 is decreased by this wear, and the resilient o-ring 22 seal in sealed bearings is exposed. If the bearing is instead an open (non-sealed or air) bearing, the wearing of the shirttail edge may expose the air bearing. Another form of shirttail wear includes wear of the shirttail outer surface 30 at locations away from the shirttail edge.

The prior art teaches two methods for delaying shirttail wear. FIG. 3 illustrates a first method in which a layer of welded hardfacing material 40 is applied to the surface 30 extending along at least a portion of the shirttail edge 32. The hardfacing material is typically a deposit of tungsten carbide hardmetal 40 applied to the surface 30. The material is typically pelletized tungsten carbide carried in a nickel welding medium. This solution does not work well when the rotary cone drill bit is run in a highly abrasive rock formation because the hardfacing material 40 wears down too quickly. It is primarily the welding medium, typically nickel, which accounts for the relative poor performance of the weld on material. FIG. 4 illustrates a second method in which tungsten carbide inserts 42 are press-fit into holes 44 formed in the surface 30 near the shirttail edge 32. While these inserts 42 provide better abrasion resistance (in comparison to the use of hardfacing material), the inserts 42 do not provide protection for the shirttail edge 32. The reason for this is that the holes 44 must be located at some appreciable distance from the shirttail edge 32 in order for the press-fit to function properly and peripherally retain the inserts 42. For example, a separation d1 of at least 0.125 inches is typically provided from the edge of the hole 44 to the shirttail edge 32. Thus, the method of FIG. 4 functions to primarily protect the shirttail region near to, but not exactly at, the shirttail edge 32. Furthermore, in order to be suitably retained, the press-fit inserts 42 must typically have a thickness t (with a corresponding depth of the hole 44) such that a ratio of the thickness of the insert to a diameter d' of the insert (where the inserts are round) or width w of the insert (with other shapes) exceeds about 0.5 (i.e., $t/d' \geqq 0.5$; or $t/w \geqq 0.5$)

A need accordingly exists in the art to provide an improved method of protecting the shirttail edge 32.

With reference once again to FIGS. 1 and 2, the outer surface 30 of the leg 12 in the shirttail region laterally terminates at a leading shirttail edge 50 and a trailing shirttail edge 52. The leading shirttail edge 50 is especially susceptible to wear during operation of the rotary cone drill bit 10. The prior art again teaches two methods for delaying wear of the leading shirttail edge 50. FIG. 5 illustrates a first method in which a layer of welded hardfacing material 40 is applied to the surface 30 extending along at least a portion of the leading shirttail edge 50. The hardfacing material is typically a deposit of tungsten carbide hardmetal 40. The material is typically pelletized tungsten carbide carried in a nickel welding medium. This solution does not work well when the rotary cone drill bit is run in a highly abrasive rock formation because the hardfacing material 40 wears down too quickly. It is primarily the welding medium, typically nickel, which accounts for the relative poor performance of the weld on material. FIG. 6 illustrates a second method in which tungsten carbide inserts 42 are press-fit into holes 44 formed in the surface 30 near the leading shirttail edge 50. While these inserts 42 provide better abrasion resistance (in comparison to the use of hardfacing material), the inserts 42 do not provide protection for the leading shirttail edge 50. The reason for this is that the holes 44 must be located at some appreciable distance from the leading shirttail edge 50 in order for the press-fit to function properly and peripherally retain the inserts 42. For example, a separation d2 of at least 0.125 inches is typically provided from the edge of the hole 44 to the leading edge 50. Thus, the method of FIG. 6 functions to primarily protect the shirttail region near to, but not exactly at, the leading shirttail edge 50. Furthermore, in order to be suitably retained, the press-fit inserts 42 must typically have a thickness t (with a corresponding depth of the hole 44) such that a ratio of the thickness of the insert to a diameter d' of the insert (where the inserts are round) or width w of the insert (with other shapes) exceeds about 0.5 (i.e., $t/d' \geqq 0.5$; or $t/w \geqq 0.5$)

A need thus exists in the art to provide an improved method of protecting the leading shirttail edge 50.

SUMMARY

In an embodiment, a rotary cone drill bit comprises: a body, a leg depending from the body, a bearing shaft extending from the leg and a cone mounted to the bearing shaft. The leg terminates at a shirttail edge adjacent a base of the cone. A bottom surface of a hard material plate is attached to a substantially conforming surface of the leg in a position along the shirttail edge.

In an embodiment, a rotary cone drill bit comprises: a body, a leg depending from the body, a bearing shaft extending from the leg and a cone mounted to the bearing shaft. A bottom surface of a hard material plate is attached to a substantially conforming surface of the leg (for example, at a surface along an edge of the shirttail region subject to wear).

In an embodiment, a rotary cone drill bit comprises: a body, a leg depending from the body, a bearing shaft extending from the leg and a cone mounted to the bearing shaft. The leg includes a location that is subject to wear during operation of the bit. A bottom surface of a hard material plate is attached to a substantially conforming surface of the leg at the location subject to wear.

In any of the foregoing embodiments, the conforming surface to which attachment is made may comprise: a floor surface formed in or by an outer shirttail surface of the leg, a floor surface formed in or by an outer surface of the leg adjacent the shirttail edge, a floor surface of an opening formed in the outer shirttail surface of the leg, or a floor surface of an opening formed in the leg adjacent the shirttail edge.

In any of the foregoing embodiments, a material for attaching the hard material plate may comprise a flowable adhesive material interposed between the bottom surface of the hard material plate to the substantially conforming surface of the leg. That material may comprise, for example, a brazing material.

In any of the foregoing embodiments, the hard material plate may comprise polycrystalline diamond compact, or be made of a material such as solid tungsten carbide or a polycrystalline cubic boron nitride compact, or comprise a diamond impregnated segment.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 7:
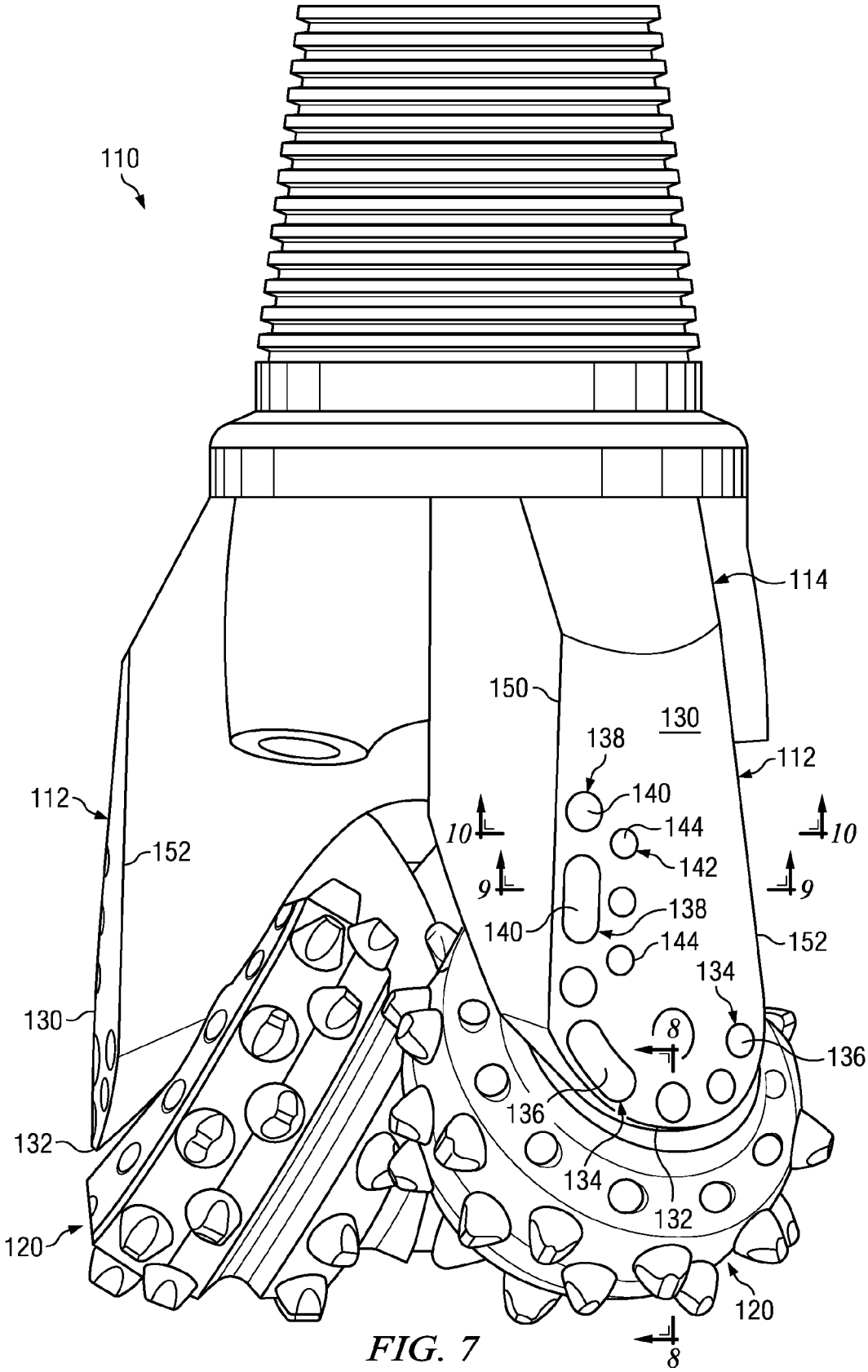
FIG. 7 illustrates an isometric view of a rotary cone drill bit including protection mechanisms for the shirttail edge and the leading edge of the shirttail.

Reference is now made to FIG. 7 which illustrates an isometric view of a rotary cone drill bit 110 including protection mechanisms for the shirttail edge and the leading edge (also referred to as the lateral leading edge) of the shirttail. A leg 112 depends from a body portion 114 of the drill bit 110. The leg 112 includes a bearing shaft (not shown, see FIG. 8 reference 116) which extends in a downward and radial inward direction. A cutter cone 120 is mounted to the bearing shaft and supported thereon for rotation. The outer surface 130 of the leg 112 terminates at a semicircular edge 132 proximal to the cone 120. The region of the leg 112 associated with the surface 130 is known in the art as the "shirttail region," and the edge 132 is known in the art as the "shirttail edge." The outer surface 130 of the leg 112 laterally terminates at a leading shirttail edge 150 and a trailing edge 152 of the shirttail. The lateral leading edge 150 and lateral trailing edge 152 of the shirttail comprise extensions of the shirttail edge 132 extending along the length of the leg 112. Although illustrated for example as including a sealed bearing system, it will be understood that the present invention is applicable to both sealed and non-sealed (air) bearing bits.

To protect the shirttail edge 132, a plurality of openings 134 are provided in the outer surface 130 of the leg 112 at locations extending along (adjacent to, but not coincident with) the shirttail edge 132, and a hard plate insert 136 is adhered to a floor surface within each opening 134. See, also, FIG. 8. To protect the lateral leading edge 150 of the shirttail, a plurality of openings 138 are provided in the outer surface 130 of the leg 112 at locations extending along (adjacent to, but not coincident with) the leading edge 150 of the shirttail, and a hard plate insert 140 is adhered to a floor surface within each opening 138. See, also, FIG. 9. To generally protect the outer surface 130, a plurality of openings 142 are provided in the outer surface 130 of the leg 112 at locations inward of and adjacent to the openings 138, and a hard plate insert 144 is adhered to a floor surface within each opening 142. See, also, FIG. 10. The openings may be milled or cast into the outer surface 130 of the leg 112 at desired positions, specifically positions on the leg which are susceptible to wear during operation of the bit.

Although all three protection mechanisms are illustrated in FIG. 7, it will be understood that any one or more of the illustrated protection mechanisms may be selected for use on the rotary cone drill bit 110. Although FIG. 7 primarily illustrates the use of circular inserts, it will be understood that the inserts can have any desired shape (including polygonal shapes, oval shapes (as shown), and the like). Furthermore, as shown in FIG. 7, the inserts can be of different sizes, perhaps with size selection depending on placement position.

It will be noted that, unlike prior art implementations, the inserts need not be press-fit into the openings, and further the inserts do not rely on a peripheral frictional retention mechanism. Rather, the inserts are adhered within the openings in a manner to be described. There is a significant advantage to the use of adhesion over press-fit retention with respect to the inserts. The use of adhesion for insert retention permits the openings in which the inserts are received to be placed closer to the shirttail edge 132 and leading edge 150 than would be possible with a press-fit installation. Additionally, two adjacent openings may be placed closer to each other than would be possible with a press-fit installation.

Figure 8:
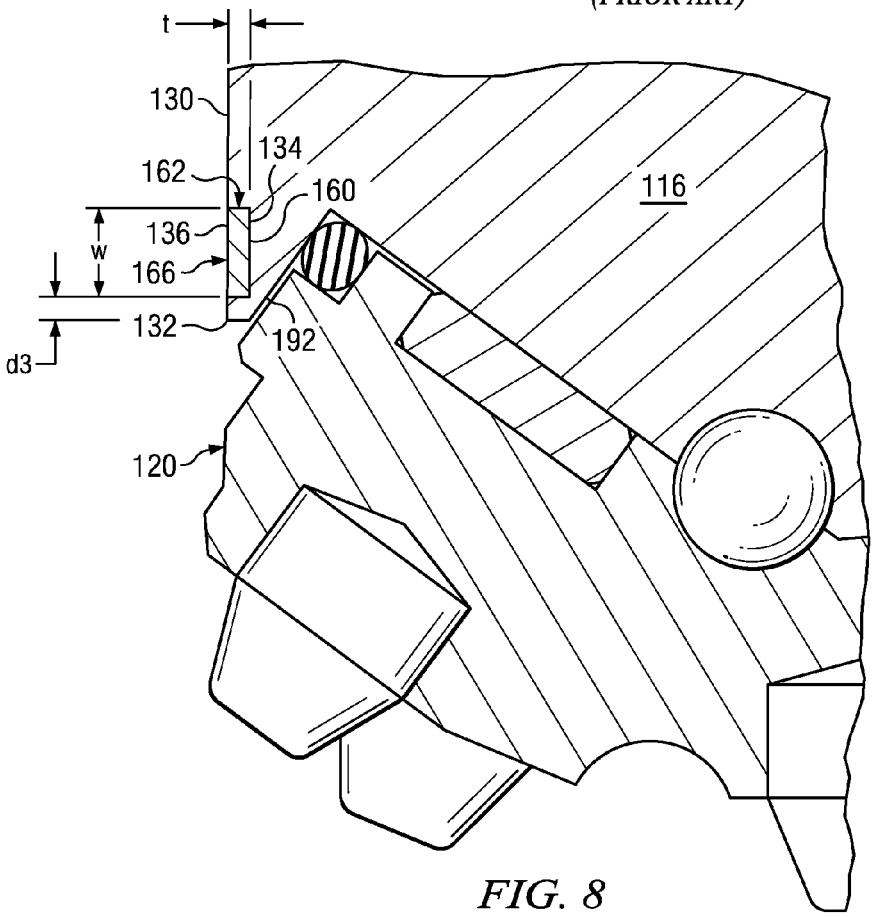
FIG. 8 illustrates a cross-sectional view of a portion of a leg of a rotary cone drill bit which includes an embodiment of a shirttail edge protection mechanism.

Reference is now made to FIG. 8 which illustrates a cross-sectional view of a portion of a leg of a rotary cone drill bit which includes an embodiment of a shirttail edge protection mechanism. In this embodiment, the opening 134 is provided in the outer surface 130 of the leg 112 near (adjacent to, but not coincident with) the shirttail edge 132. The opening 134 may be milled or cast into the outer surface 130 of the leg 112. The opening 134 is defined by a floor surface 160 and a peripheral wall 162 (the floor surface may, for example, be flat). The hard plate insert 136 is adhered within the opening 134, but does not require frictional retention with respect to the peripheral wall 162. In a preferred embodiment, a bottom surface of hard plate insert is adhered to the floor surface 160 of the opening 134. The bottom surface of the insert conforms to the floor surface of the opening (and thus, for example, may be a flat surface). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 8, but it will be understood that the adhesive material is present between the conforming bottom surface and floor surface. The adhesive material preferably has a substantially uniform thickness between the conforming bottom surface and floor surface. The hard plate insert 136 has a thickness such that when adhered within the opening 134, a top surface 166 of the plate insert 136 is substantially flush with, or slightly exposed beyond, or slightly recessed below, the outer surface 130 of the leg 112. The hard plate insert 136 is made of a material or combination of materials which are more abrasion resistant than the material used to make the leg and shirttail of the bit. In a preferred implementation, the hard plate insert is made of a material such as solid tungsten carbide, polycrystalline diamond compact (PDC), polycrystalline cubic boron nitride compact, impregnated diamond segment, and the like. These materials are superior to the traditional weld on tungsten carbide hardfacing known in the prior art because they are denser and are not as susceptible to abrasion and erosion.

The shirttail edge 132 is provided where the terminal portion of the surface 130 transitions to an inside radial surface 192 oriented parallel to the base of the cone 120 (perpendicular to the bearing shaft 116) and positioned at the base of the bearing shaft 116. The hard plate inserts 136 function to protect against wearing of the shirttail edge 132 and erosion of the inside radial surface 192. The depth of the opening 134 is limited by its position proximal to the shirttail edge 132 (and thus close to the radial surface 192). If a thin plate insert 136 is used, the opening 134 can be moved very close to the shirttail edge 132 without reaching the surface 192. For example, a separation d3 (where d3<d1) of 0.050 to 0.120 inches could be used from edge of the opening 134 to the shirttail edge 132 (with an insert thickness in the range of 0.050 to 0.500 inches). It is at the conforming floor surface 160 where adhesion (for example, through brazing) is made to the hard plate insert 136. In this way, the adhesive material, unlike prior art techniques, is not externally exposed and subject to possible wear. The conforming surfaces where adhesion takes place may curve, for example, with the radius of the bit, or have any selected curved configuration. Although a sealed bearing system is illustrated, it will be understood that protection in accordance with the present invention is applicable to both sealed and non-sealed (air) bearing bits.

Figure 1:
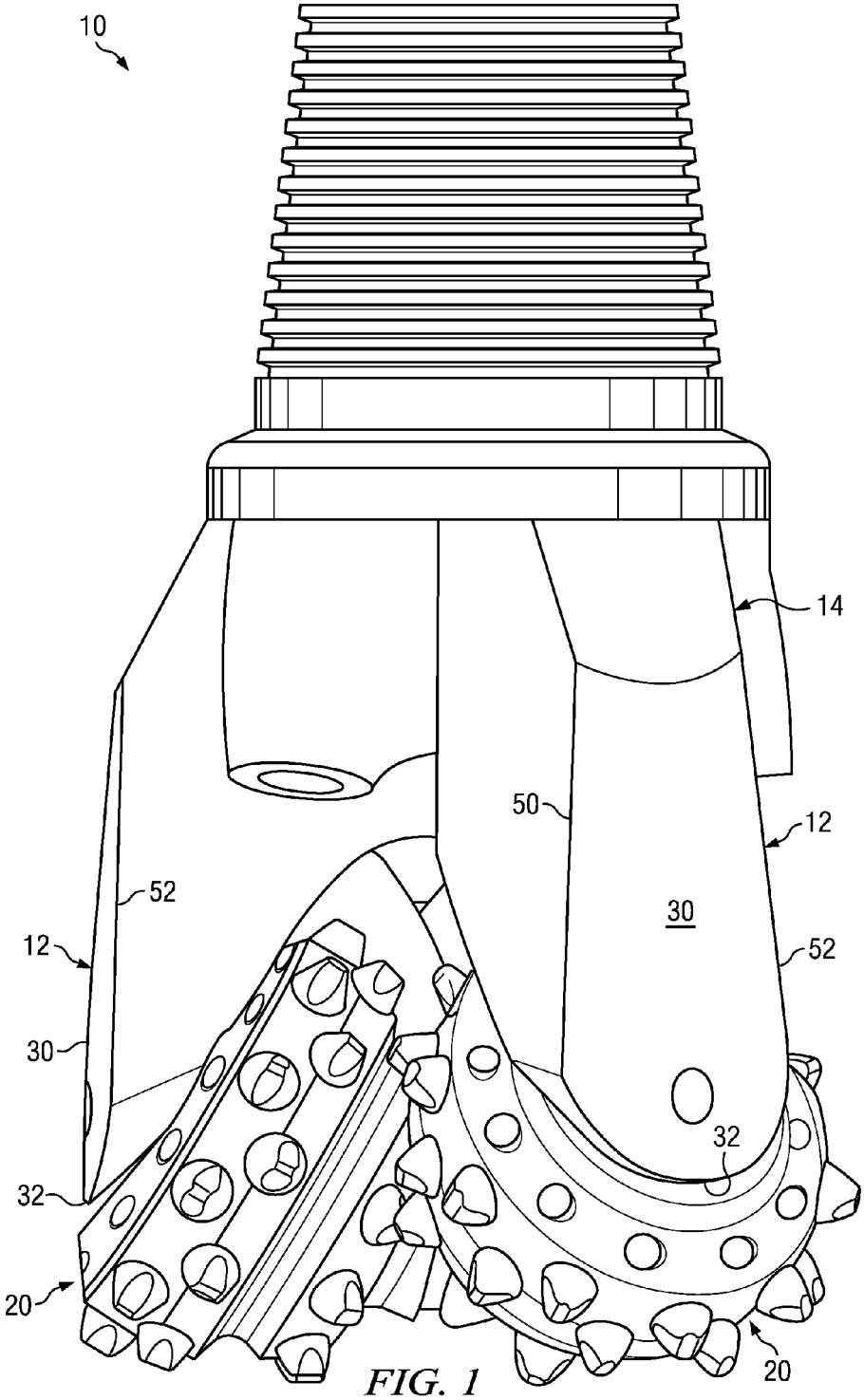
FIG. 1 (PRIOR ART)
FIG. 1 illustrates an isometric view of a prior art rotary cone drill bit.
Figure 2:
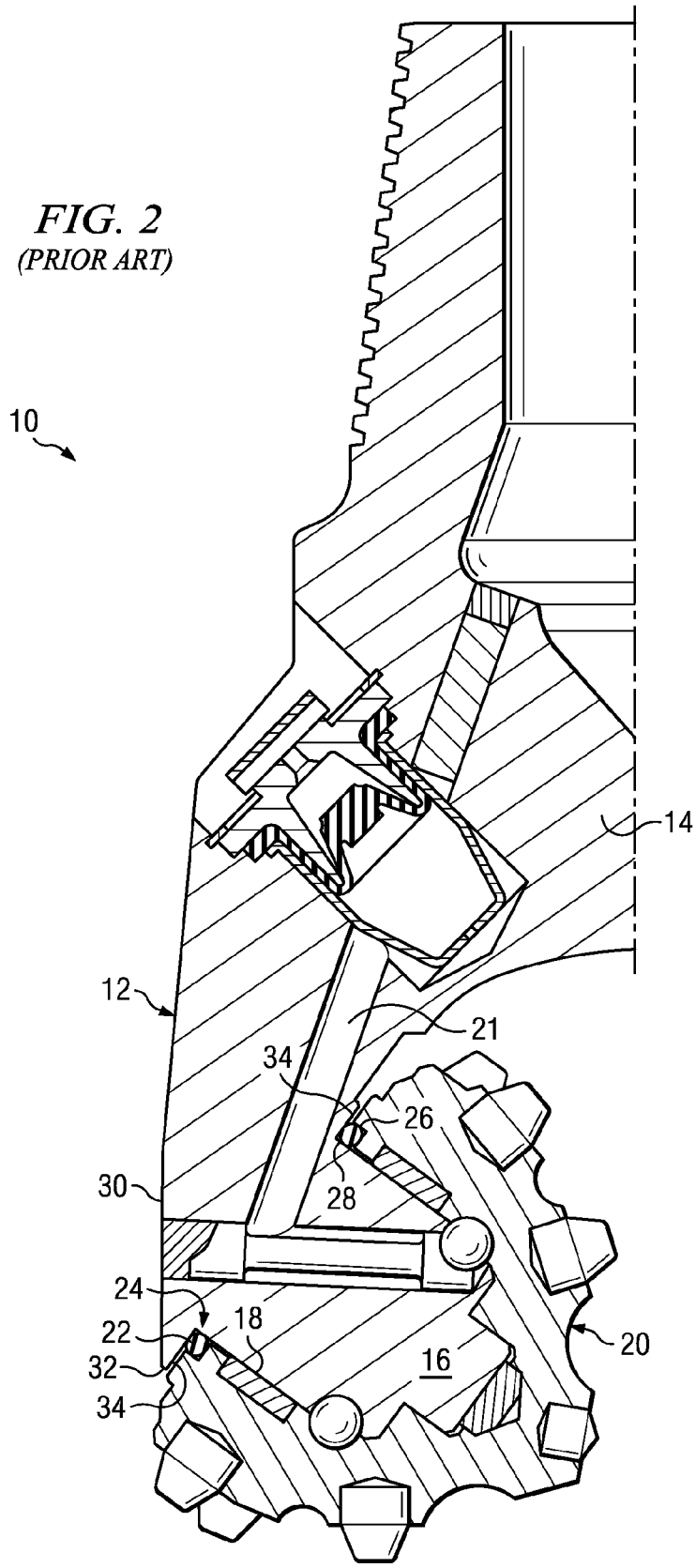
FIG. 2 (PRIOR ART)
FIG. 2 illustrates a cross-sectional view of a portion of a leg of the prior art rotary cone drill bit of FIG. 1.
Figure 4:
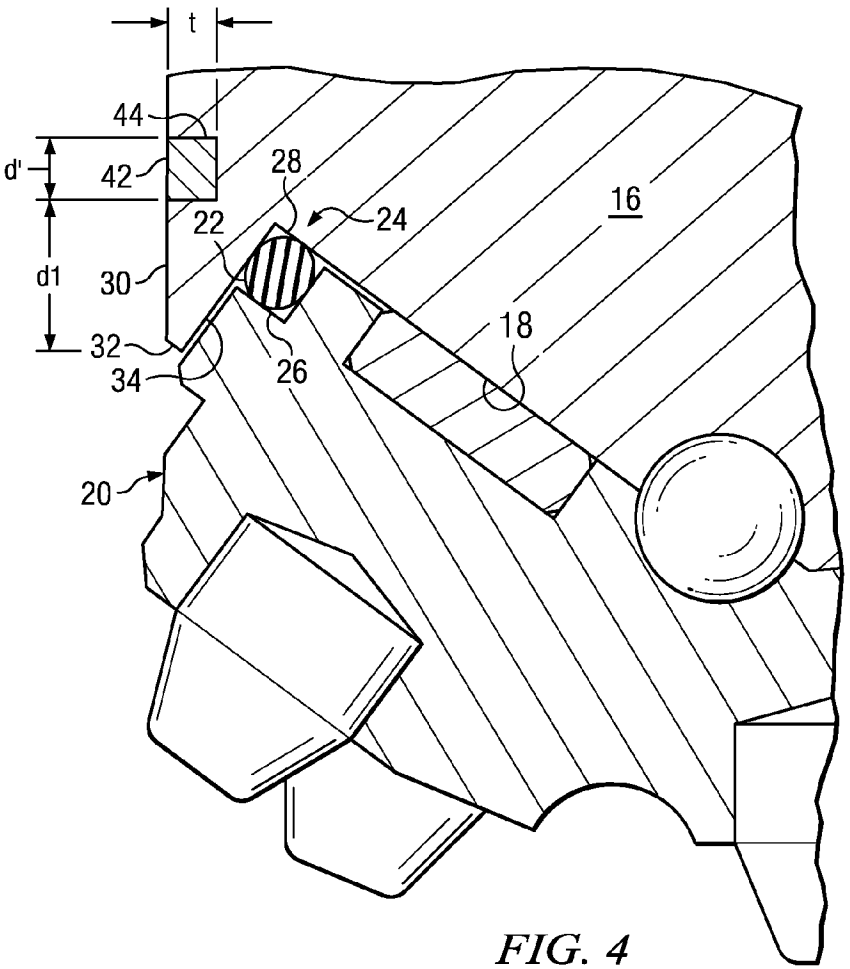
FIG. 4 (PRIOR ART)
FIG. 4 illustrates the use of tungsten carbide inserts near the shirttail edge.
Figure 3:
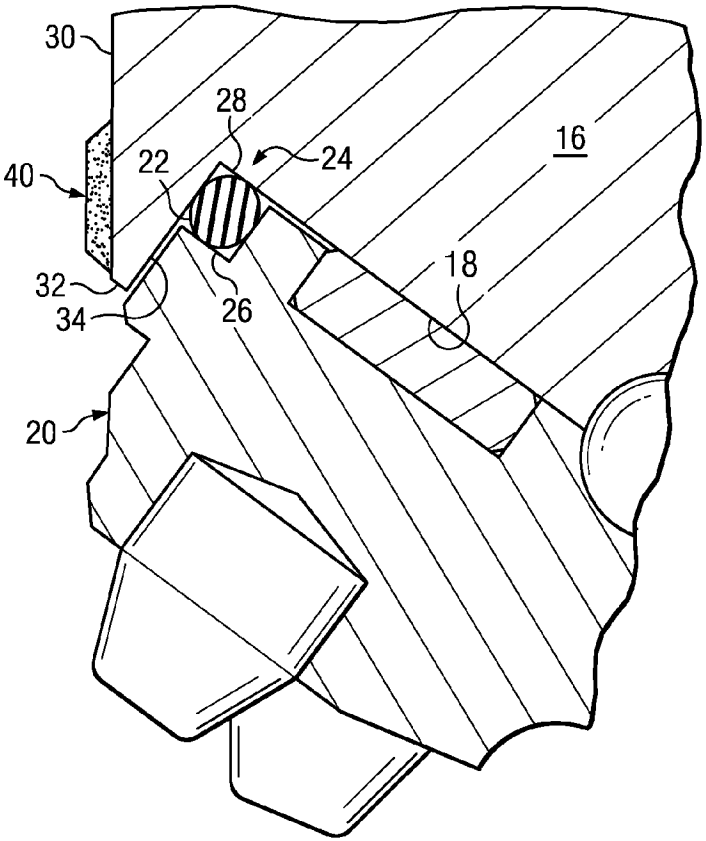
FIG. 3 (PRIOR ART)
FIG. 3 illustrates application of a layer of hardfacing material extending along at least a portion of the shirttail edge.
Figure 5:
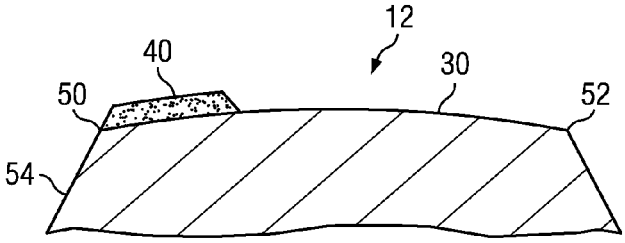
FIG. 5 (PRIOR ART)
FIG. 5 illustrates application of a layer of hardfacing material extending along at least a portion of the leading edge of the shirttail.
Figure 6:
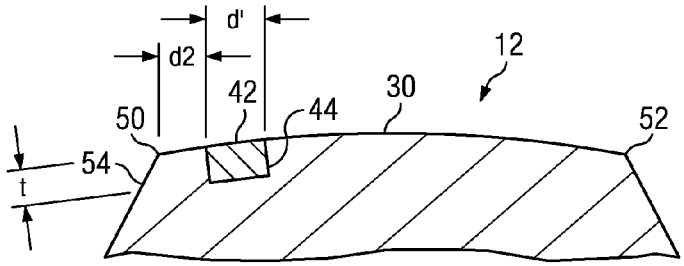
FIG. 6 (PRIOR ART)
FIG. 6 illustrates the use of tungsten carbide inserts near the leading edge of the shirttail.

The hard plate inserts 136 have a thickness t and width w (wherein the width is measured in a direction perpendicular to the shirttail edge 132). The hard plate inserts 136 are thin inserts. In this case, a ratio of the thickness t of the insert to a width w of the insert is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 136 are retained by adhesion to their bottom surface and not their peripheral edge (as is the case with the press-fit inserts used in the prior art (see, FIG. 4)).

Figure 9:
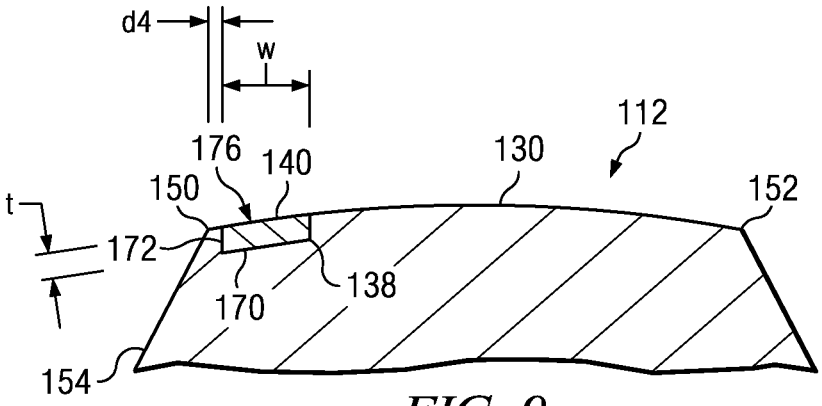
FIGS. 9 and 10 illustrate cross-sectional views of a portion of a leg of a rotary cone drill bit which include embodiments of a mechanism for protecting the leading edge of the shirttail.

Reference is now made to FIG. 9 which illustrates a cross-sectional view of a portion of a leg of a rotary cone drill bit which includes an embodiment of a protection mechanism for the lateral leading edge of the shirttail. In this embodiment, the opening 138 is provided in the outer surface 130 of the leg 112 near (adjacent to, but not coincident with) the leading shirttail edge 150. The opening 138 may be milled or cast into the outer surface 130 of the leg 112. The opening 138 is defined by a floor surface 170 and a peripheral wall 172 (the floor surface may, for example, be flat). There is a greater degree of freedom at this position with respect to selecting the depth of the opening 138. The hard plate insert 140 is adhered within the opening 138, but does not require a frictional retention with respect to the peripheral wall 172. In a preferred embodiment, a bottom surface of hard plate insert is adhered to the floor surface 170 of the opening 138. The bottom surface of the insert conforms to the floor surface of the opening (and thus, for example, may be a flat surface). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 9, but it will be understood that the adhesive material is present between the conforming bottom surface and floor surface. The adhesive material preferably has a substantially uniform thickness between the conforming bottom surface and floor surface. The hard plate insert 140 has a thickness such that when adhered within the opening 138, a top surface 176 of the plate insert 140 is substantially flush with, or slightly exposed beyond, or slightly recessed from, the outer surface 130 of the leg 112. The hard plate insert 140 is made of a material or combination of materials which are more abrasion resistant than the material used to make the leg and shirttail of the bit. In a preferred implementation, the hard plate insert is made of a material such as solid tungsten carbide, polycrystalline diamond compact (PDC), polycrystalline cubic boron nitride compact, impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plate inserts 140 have a thickness t and width w (wherein the width is measured in a direction perpendicular to the leading edge 150). The hard plate inserts 140 are thin inserts. In this case, a ratio of the thickness t of the insert to a width w of the insert is less than 0.5 (i.e., t/w<0.5). More particularly, the ratio of the thickness t of the insert to the width w of the insert is substantially less than 0.5 (i.e., t/w<<0.5). Even more particularly, the ratio of the thickness t of the insert to the width w of the insert is less than 0.2 (i.e., t/w<0.2), and may even be less than 0.1 (i.e., t/w<0.1). This is permitted because the hard plate inserts 140 are retained by adhesion to their bottom surface and not their peripheral edge (as is the case with the press-fit inserts used in the prior art (see, FIG. 4).

Figure 10:
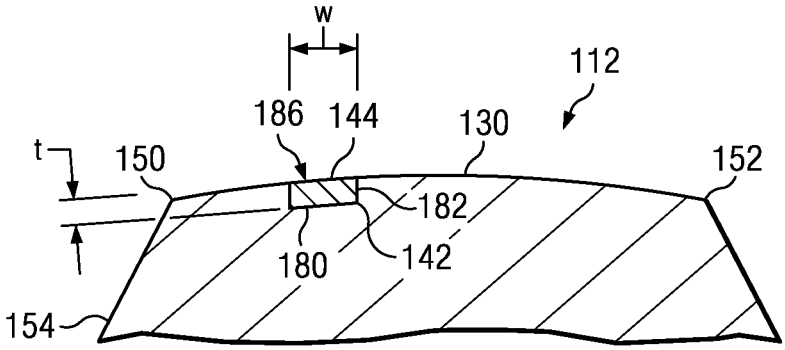

Reference is now made to FIG. 10 which illustrates a cross-sectional view of a portion of a leg of a rotary cone drill bit which includes an embodiment of a protection mechanism for the lateral leading edge of the shirttail. In this embodiment, the opening 142 is provided in the outer surface 130 of the leg 112. The opening 142 may be milled or cast into the outer surface 130 of the leg 112. The opening 142 is defined by a floor surface 180 and a peripheral wall 182 (the floor surface may, for example, be flat). There is a greater degree of freedom at this position with respect to selecting the depth of the opening 142. The hard plate insert 144 is adhered within the opening 142, but does not require a frictional retention with respect to the peripheral wall 182. In a preferred embodiment, a bottom surface of hard plate insert is adhered to the floor surface 180 of the opening 142. The bottom surface of the insert conforms to the floor surface of the opening (and thus, for example, may be a flat surface). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 10, but it will be understood that the adhesive material is present between the conforming bottom surface and floor surface. The adhesive material preferably has a substantially uniform thickness between the conforming bottom surface and floor surface. The hard plate insert 144 has a thickness such that when adhered within the opening 142, a top surface 186 of the plate insert 144 is substantially flush with, or slightly exposed beyond, or slightly recessed from, the outer surface 130 of the leg 112. The hard plate insert 144 is made of a material or combination of materials which are more abrasion resistant than the material used to make the leg and shirttail of the bit. In a preferred implementation, the hard plate insert is made of a material such as solid tungsten carbide, polycrystalline diamond compact (PDC), cubic boron nitride, and the like. Again, the adhesive material is this implementation is not externally exposed and subject to possible wear. The conforming surfaces where adhesion takes place may curve, for example, with the radius of the bit, or have any selected curved configuration.

The hard plate inserts 144 have a thickness t and width w (wherein the width is measured in a direction providing the smallest w value). The hard plate inserts 144 are thin inserts. In this case, a ratio of the thickness t of the insert to a width w of the insert to is less than 0.5 (i.e., t/w<0.5). More particularly, the ratio of the thickness t of the insert to the width w of the insert is substantially less than 0.5 (i.e., t/w<<0.5). Even more particularly, the ratio of the thickness t of the insert to the width w of the insert is less than 0.2 (i.e., t/w<0.2), and may even be less than 0.1 (i.e., t/w<0.1). This is permitted because the hard plate inserts 144 are retained by adhesion to their bottom surface and not their peripheral edge (as is the case with the press-fit inserts used in the prior art (see, FIG. 4).

It will be noted that the openings and plate inserts may be of any selected geometry and arrangement thus allowing for the application of protection to complex surfaces of the bit.

The opening 138 can be moved very close to the leading edge 150. For example, a separation d4 (where d4<d2) of 0.000 to 0.120 inches could be used from edge of the opening 138 to the leading edge 150. Furthermore, the openings 134, 138 and 142 can be moved very close to each other because the inserts are retained by bottom surface adhesion. For example, separations as small as, or smaller than, d3 or d4 could be used between openings 134, 138 and 142.

The illustration of protection being applied using openings and plate inserts along the shirttail edge and/or leading shirttail edge and/or shirttail outer surface is by way of example only, it being understood that the protection mechanisms described can be applied to any edge or surface of the bit susceptible to wear.

Figure 11:
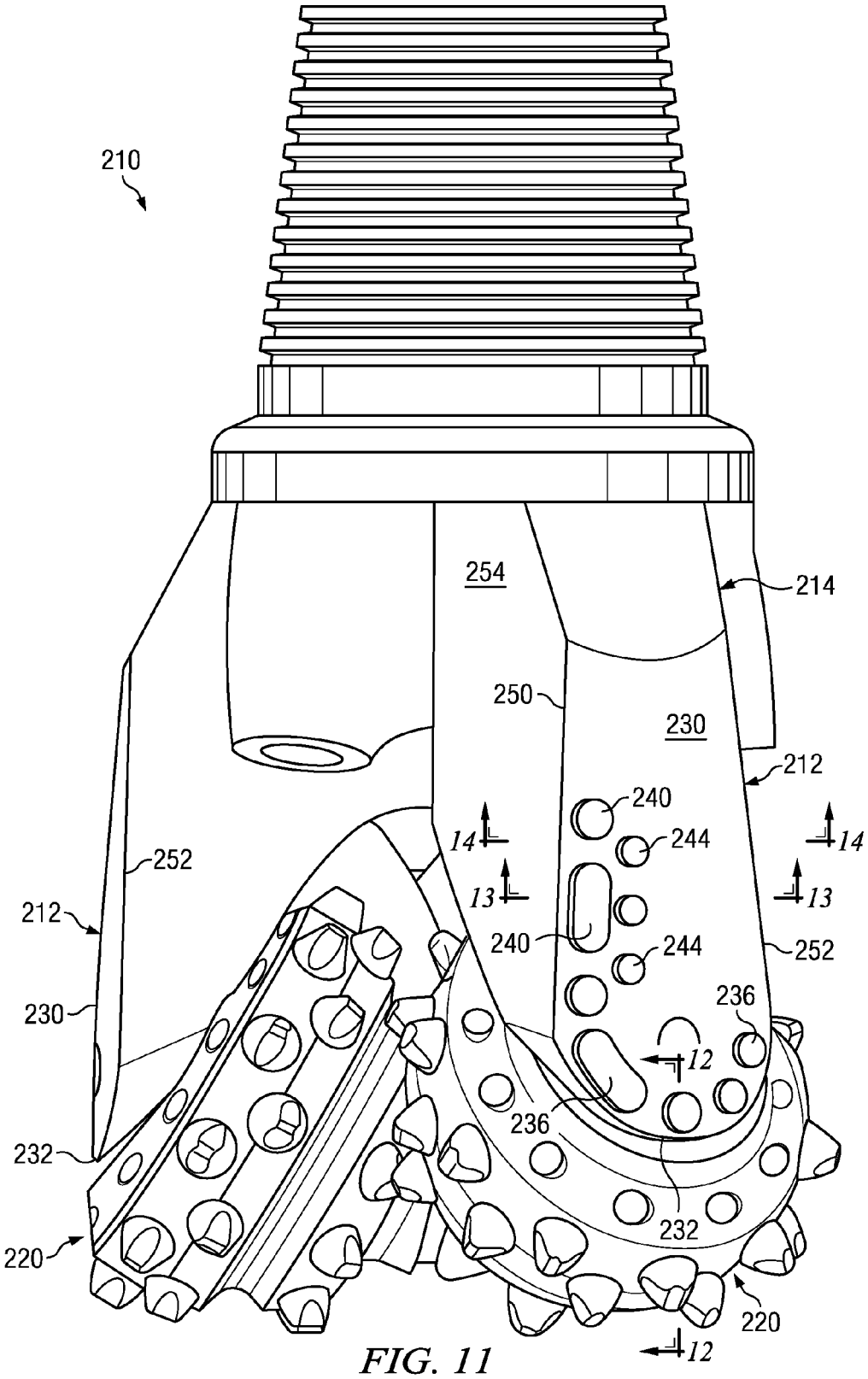
FIG. 11 illustrates an isometric view of a rotary cone drill bit including protection mechanisms for the shirttail edge and the leading edge of the shirttail.

Reference is now made to FIG. 11 which illustrates an isometric view of a rotary cone drill bit 210 including protection mechanisms for the shirttail edge and the leading edge of the shirttail. A leg 212 depends from a body portion 214 of the drill bit 210. The leg 212 includes a bearing shaft (not shown, see FIG. 14 reference 216) which extends in a downward and radial inward direction. A cutter cone 220 is mounted to the bearing shaft and supported thereon for rotation. The outer surface 230 of the leg 212 terminates at a semicircular edge 232 proximal to the cone 220. The region of the leg 212 associated with the surface 230 is known in the art as the "shirttail region," and the edge 232 is known in the art as the "shirttail edge." The outer surface 230 of the leg 212 laterally terminates at a leading shirttail edge 250 and a trailing edge 252 of the shirttail. The leading edge 250 and a trailing edge 252 of the shirttail comprise extensions of the shirttail edge 232 extending along the length of the leg 212. The shirttail region further includes a leading side surface 254 which is adjacent the outer surface 230 of the leg 212 at the leading shirttail edge 250. Although illustrated for example as including a sealed bearing system, it will be understood that the present invention is applicable to both sealed and non-sealed (air) bearing bits.

To protect the shirttail edge 232, a plurality of hard plates 236 are adhered to a floor surface 231 provided in or by the curved outer surface 230 of the leg 212 at locations along (adjacent to, but not coincident with) the shirttail edge 232. See, also, FIG. 12. To protect the leading edge 250 of the shirttail, a plurality of hard plates 240 are adhered to a floor surface 231 provided in or by the curved outer surface 230 of the leg 212 at locations along (adjacent to, but not coincident with) the leading edge 250 of the shirttail. See, also, FIG. 13. To generally protect the outer surface 230, a plurality of hard plates 244 are adhered to a floor surface 231 provided in or by the curved outer surface 230 of the leg 212 at locations inward of and adjacent to the plates 240. See, also, FIG. 14. The hard plates may be located at desired positions, specifically positions on the leg which are susceptible to wear during operation of the bit. Although all three protection mechanisms are illustrated in FIG. 11, it will be understood that any one or more of the protection mechanisms may be selected for use on the rotary cone drill bit 210. The floor surfaces 231 are preferably machined or cast into the curved outer surfaces of the shirttail region.

Although FIG. 11 primarily illustrates the use of circular plates, it will be understood that the plates can have any desired shape (including polygonal shapes, oval shapes (as shown), and the like). Furthermore, as shown in FIG. 11, the plates can be of different sizes, perhaps with size selection depending on placement position.

Figure 12:
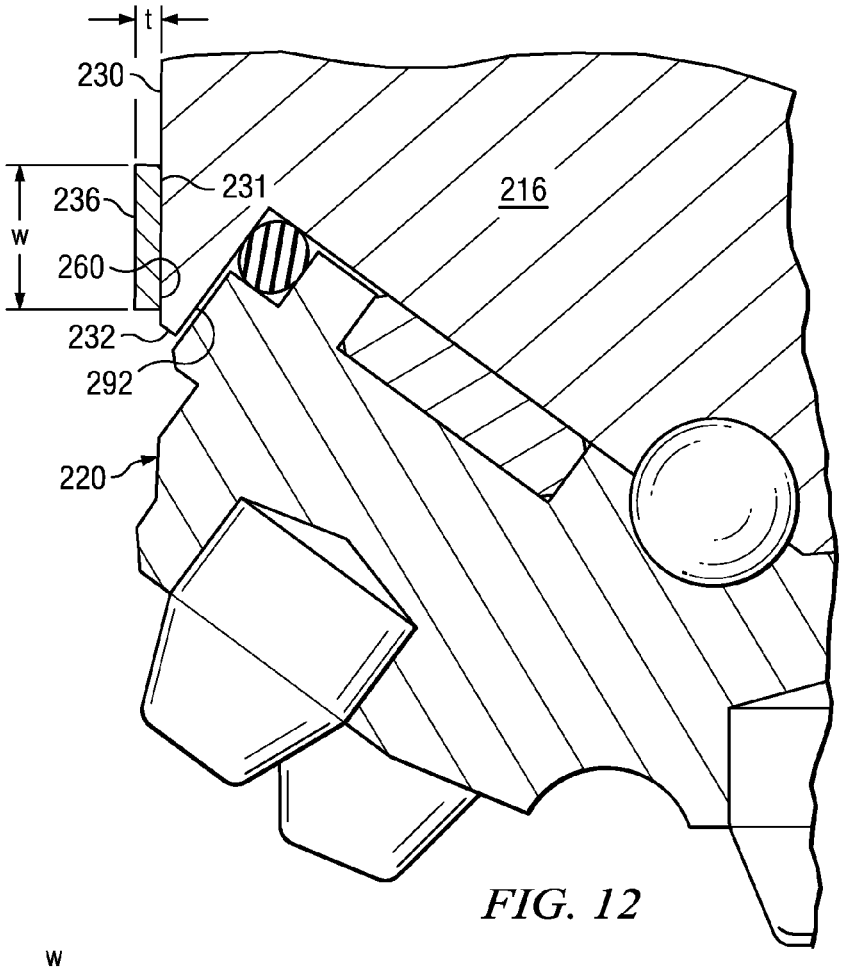
FIG. 12 illustrates a cross-sectional view of a portion of a leg of a rotary cone drill bit which includes an embodiment of a shirttail edge protection mechanism.

Reference is now made to FIG. 12 which illustrates a cross-sectional view of a portion of a leg of a rotary cone drill bit which includes an embodiment of a shirttail edge protection mechanism. In this embodiment, the bottom surface 260 of the hard plate 236 is adhered to a substantially conforming floor surface 231 provided in or by the curved outer surface 230 of the leg 212 near (adjacent to, but not coincident with) the shirttail edge 232. The floor surface may, for example, be a flattened surface formed in the outer surface. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 12, but it will be understood that the adhesive material is present between the confirming bottom surface and floor surface. The adhesive material preferably has a substantially uniform thickness between the conforming bottom surface and floor surface. The thickness of the plate 236 may range from 0.050 to 0.500 inches. The hard plate 236 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact, impregnated diamond segment, and the like. These materials are superior to the traditional weld on tungsten carbide hardfacing known in the prior art because they are denser and are not as susceptible to abrasion and erosion. The conforming surfaces where adhesion takes place may curve, for example, with the radius of the bit, or have any selected curved configuration. The shirttail edge 232 is provided where the terminal portion of the surface 230 transitions to an inside radial surface 292 oriented parallel to the base of the cone 220 (perpendicular to the bearing shaft 216) and positioned at the base of the bearing shaft 216. The hard plates 236 function to protect against wearing of the shirttail edge 232 and erosion of the inside radial surface 292. It is at the floor surface 231 on the outer surface 230 where adhesion (for example, through brazing) is made to the bottom surface 260 of the hard plate 236. In this way, the adhesive material, unlike prior art techniques, is not externally exposed and subject to possible wear. Although a sealed bearing system is illustrated, it will be understood that protection in accordance with the present invention is applicable to both sealed and non-sealed (air) bearing bits.

The hard plates 236 have a thickness t and width w (wherein the width is measured in a direction perpendicular to the shirttail edge 232). The hard plates 236 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 13:
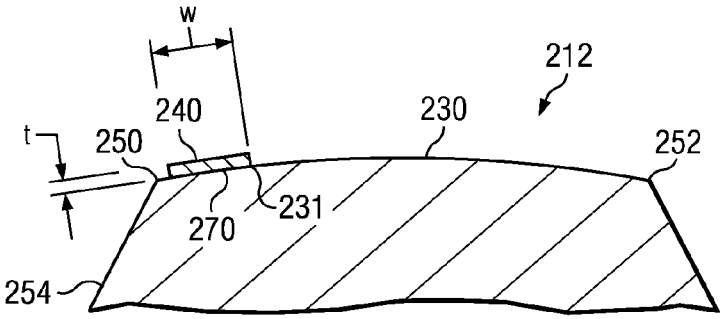
FIGS. 13 and 14 illustrate cross-sectional views of a portion of a leg of a rotary cone drill bit which include embodiments of a mechanism for protecting the leading edge of the shirttail.

Reference is now made to FIG. 13 which illustrates a cross-sectional view of a portion of a leg of a rotary cone drill bit which includes an embodiment of a protection mechanism for the leading edge of the shirttail. In this embodiment, the bottom surface 270 of the hard plate 240 is adhered to a substantially conforming floor surface 231 provided in or by the curved outer surface 230 of the leg 212 near (adjacent to, but not coincident with) the leading shirttail edge 250. The floor surface could, for example, be a flattened surface formed in the outer surface. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 13, but it will be understood that the adhesive material is present between the conforming bottom surface and outer surface. The adhesive material preferably has a substantially uniform thickness between the conforming bottom surface and floor surface. The thickness of the plate 240 may range from 0.050 to 0.500 inches. The hard plate 240 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact, impregnated diamond segment, and the like. Again, the adhesive material is this implementation is not externally exposed and subject to possible wear. The conforming surfaces where adhesion takes place may curve, for example, with the radius of the bit, or have any selected curved configuration.

The hard plates 240 have a thickness t and width w (wherein the width is measured in a direction perpendicular to the leading edge 250). The hard plates 240 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 14:
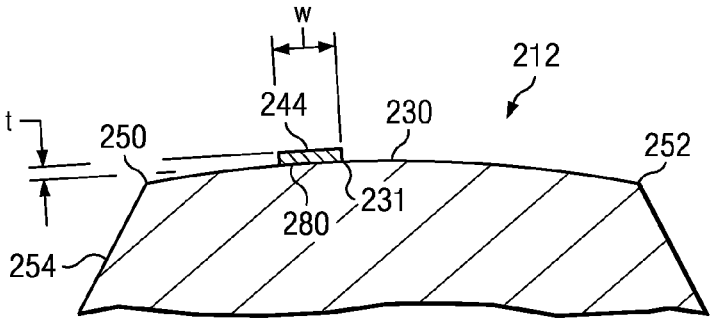

Reference is now made to FIG. 14 which illustrates a cross-sectional view of a portion of a leg of a rotary cone drill bit which includes an embodiment of a protection mechanism for the leading edge of the shirttail. In this embodiment, the bottom surface 280 of the hard plate 244 is adhered to a substantially conforming floor surface 231 provided in or by the outer surface 230 of the leg 212 adjacent the plates 240. The floor surface could, for example, be a flattened surface formed in the outer surface. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 16, but it will be understood that the adhesive material is present between the conforming bottom surface and floor surface. The adhesive material preferably has a substantially uniform thickness between the conforming bottom surface and floor surface. The thickness of the plate 244 may range from 0.050 to 0.500 inches. The hard plate 244 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact, impregnated diamond segment, and the like. Again, the adhesive material is this implementation is not externally exposed and subject to possible wear. The conforming surfaces where adhesion takes place may curve, for example, with the radius of the bit, or have any selected curved configuration.

The hard plates 244 have a thickness t and width w (wherein the width is measured in a direction providing the smallest w value). The hard plates 244 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

It will be noted that the hard plates may be of any selected geometry thus allowing for the application of protection to complex surfaces of the bit.

The illustration of protection being applied using plates at the shirttail edge and/or leading shirttail edge and/or shirttail outer surface is by way of example only, it being understood that the protection mechanisms described can be applied to any edge or surface of the bit susceptible to wear.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A rotary cone drill bit, comprising:
a body;
a leg depending from the body;
a bearing shaft extending from the leg;
a cone mounted to the bearing shaft;
wherein the leg terminates at a shirttail edge adjacent a base of the cone;
a preformed hard material plate having a bottom surface;
an adhesive material attaching the bottom surface of the hard material plate to a substantially conforming surface of the leg at a position along the shirttail edge.

2. The bit of claim 1 wherein the leg includes an outer surface, and the bottom surface of the hard material plate is attached by the adhesive material to a floor surface formed in or by the outer surface of the leg.

3. The bit of claim 2 wherein the adhesive material attaching the bottom surface of the hard material plate to the floor surface of the leg comprises a flowable adhesive material interposed between the conforming bottom surface of the hard material plate and floor surface of the leg.

4. The bit of claim 3 wherein the flowable adhesive material is a brazing material.

5. The bit of claim 1 wherein the leg includes an outer surface, and an opening is provided in the outer surface near the shirttail edge, the opening including a floor surface of the leg, and wherein the bottom surface of the hard material plate is attached by the adhesive material to the floor surface provided by the opening in the outer surface of the leg.

6. The bit of claim 5 wherein the adhesive material attaching the bottom surface of the hard material plate to the floor surface of the opening comprises a flowable adhesive material interposed between the bottom surface of the hard material plate and the floor surface of the opening.

7. The bit of claim 6 wherein the flowable adhesive material is a brazing material.

8. The bit of claim 1 wherein the hard material plate has width w and a thickness t, wherein a ratio $t/w<0.5$.

9. The bit of claim 1 wherein the hard material plate is made of solid tungsten carbide.

10. The bit of claim 1 wherein the hard material plate is one of a polycrystalline diamond compact or an impregnated diamond segment.

11. The bit of claim 1 wherein the hard material plate is a polycrystalline cubic boron nitride compact.

12. A rotary cone drill bit, comprising:
a body;
a leg depending from the body;
a bearing shaft extending from the leg;
a cone mounted to the bearing shaft;
a preformed hard material plate having a bottom surface;
an adhesive material attaching the bottom surface of the hard material plate to a substantially conforming surface of the leg.

13. The bit of claim 12 wherein the leg includes a leading side surface and an outer surface adjacent thereto at a lateral leading edge of the leg, and the bottom surface of the hard material plate is attached by the adhesive material to a floor surface formed in or by the outer surface of the leg at a position adjacent to the lateral leading edge.

14. The bit of claim 13 wherein the adhesive material attaching the bottom surface of the hard material plate to the floor surface of the leg comprises a flowable adhesive material interposed between the bottom surface of the hard material plate and floor surface of the leg.

15. The bit of claim 14 wherein the flowable adhesive material is a brazing material.

16. The bit of claim 12 wherein the leg includes a leading side surface and an outer surface adjacent thereto at a lateral leading edge of the leg, and an opening is provided in the outer surface adjacent to the lateral leading edge, the opening including a floor surface of the leg, and wherein the bottom surface of the hard material plate is attached by the adhesive material to the floor surface provided by the opening in the outer surface of the leg.

17. The bit of claim 16 wherein the adhesive material attaching the bottom surface of the hard material plate to the floor surface of the opening comprises a flowable adhesive material interposed between the bottom surface of the hard material plate and floor surface of the opening.

18. The bit of claim 17 wherein the flowable adhesive material is a brazing material.

19. The bit of claim 12 wherein the leg includes an outer surface, and the bottom surface of the hard material plate is attached by the adhesive material to a floor surface formed in or by the outer surface of the leg.

20. The bit of claim 19 wherein the adhesive material attaching the bottom surface of the hard material plate to the floor surface of the leg comprises a flowable adhesive material interposed between the bottom surface of the hard material plate and floor surface of the leg.

21. The bit of claim 20 wherein the flowable adhesive material is a brazing material.

22. The bit of claim 12 wherein the leg includes an outer surface, and an opening is provided in the outer surface, the opening including a floor surface of the leg, and wherein the bottom surface of the hard material plate is attached by the adhesive material to the floor surface provided by the opening in the outer surface of the leg.

23. The bit of claim 22 wherein the adhesive material attaching the bottom surface of the hard material plate to the floor surface of the opening comprises a flowable adhesive material interposed between the bottom surface of the hard material plate and the floor surface of the opening.

24. The bit of claim 23 wherein the flowable adhesive material is a brazing material.

25. The bit of claim 12 wherein the hard material plate has width w and a thickness t, wherein a ratio $t/w<0.5$.

26. The bit of claim 12 wherein the hard material plate is made of solid tungsten carbide.

27. The bit of claim 12 wherein the hard material plate is one of a polycrystalline diamond compact or an impregnated diamond segment.

28. The bit of claim 12 wherein the hard material plate is a polycrystalline cubic boron nitride compact.

29. A rotary cone drill bit, comprising:

a body;

a leg depending from the body;

a bearing shaft extending from the leg;

a cone mounted to the bearing shaft;

wherein the leg includes a location that is subject to wear during operation of the bit;

a preformed hard material plate having a bottom surface;

an adhesive material attaching the bottom surface of the hard material plate to a substantially conforming surface of the leg at the location subject to wear.

30. The bit of claim 29 wherein the location subject to wear is an outer surface of the leg, and the bottom surface of the hard material plate is attached by the adhesive material to a conforming floor surface formed in or by the outer surface of the leg at the location subject to wear.

31. The bit of claim 30 wherein the adhesive material attaching the bottom surface of the hard material plate to the surface of the leg comprises a flowable adhesive material interposed between the bottom surface of the hard material plate and the floor surface of the leg.

32. The bit of claim 31 wherein the flowable adhesive material is a brazing material.

33. The bit of claim 29 wherein the location subject to wear is an outer surface of the leg, further comprising an opening in the outer surface of the leg formed at the location subject to wear, the opening having a floor surface, and wherein the bottom surface of the hard material plate is attached by the adhesive material to the floor surface of the opening.

34. The bit of claim 33 wherein the adhesive material attaching the bottom surface of the hard material plate to the surface of the leg comprises a flowable adhesive material interposed between the bottom surface of the hard material plate and the floor surface of the opening.

35. The bit of claim 34 wherein the flowable adhesive material is a brazing material.

36. The bit of claim 29 wherein the hard material plate has width w and a thickness t, wherein a ratio $t/w<0.5$.

37. The bit of claim 29 wherein the hard material plate has width w and a thickness t, wherein a ratio $t/w<0.2$.

38. The bit of claim 29 wherein the hard material plate has width w and a thickness t, wherein a ratio $t/w<0.1$.

* * * * *